US007820929B2

(12) United States Patent
Thorp et al.

(10) Patent No.: US 7,820,929 B2
(45) Date of Patent: Oct. 26, 2010

(54) ELECTRICAL INTERFACE SHIELD AND METHOD

(76) Inventors: Dale N. Thorp, 12 Morgan Pl., Unionville, CT (US) 06085; Jerold L. John, 12 Beaverbrook Rd., West Simsbury, CT (US) 06082; Tony Cammarano, 61 Warragoon Crescent, Perth (AU) 6156

( * ) Notice: Subject to any disclaimer, the term of this patent is extended or adjusted under 35 U.S.C. 154(b) by 295 days.

(21) Appl. No.: 12/102,113

(22) Filed: Apr. 14, 2008

(65) Prior Publication Data

US 2008/0302644 A1 Dec. 11, 2008

Related U.S. Application Data

(60) Provisional application No. 60/934,131, filed on Jun. 11, 2007.

(51) Int. Cl.
*H01H 13/04* (2006.01)

(52) U.S. Cl. ..... 200/333; 200/293

(58) Field of Classification Search ..... 200/333
See application file for complete search history.

(56) References Cited

U.S. PATENT DOCUMENTS 2,880,264 A * 3/1959 Ruskin ..... 174/67
5,763,831 A * 6/1998 Shotey et al. ..... 174/67
5,955,702 A * 9/1999 Grossman et al. ..... 174/66
6,087,588 A * 7/2000 Soules ..... 174/66
6,218,616 B1 4/2001 Bates et al.
6,586,694 B2 7/2003 Shotey et al.
D507,476 S 7/2005 Zahedi et al.
D514,922 S 2/2006 Zahedi et al.
7,214,898 B1 5/2007 Margareten

* cited by examiner

*Primary Examiner*—Renee Luebke
*Assistant Examiner*—Lisa Klaus
(74) *Attorney, Agent, or Firm*—Cantor Colburn LLP

(57) ABSTRACT

Disclosed herein is an electrical interface shield. The shield includes, a transparent support member having a first end and a second end, a transparent housing hingedly attached at the first end of the transparent support member and latchably engagable with the second end, and at least one brace. The at least one brace has at least one mounting hole therethrough and is removably attached to the transparent support member and the at least one mounting hole is configured to receive a fastener therein for mounting the transparent support member to an electrical interface frame.

15 Claims, 5 Drawing Sheets

ELECTRICAL INTERFACE SHIELD AND METHOD

CROSS REFERENCE TO RELATED APPLICATIONS

This application claims priority to U.S. provisional application, 60/934,131, filed Jun. 11, 2007, the entire contents of which are incorporated herein by reference.

BACKGROUND OF THE INVENTION

It may be desirable to provide a shield over an electrical interface, such as a wall light switch or electrical power outlet, for example, to prevent inadvertent contact with or operation thereof. Permanent attachment of a cover over such electrical interface is one approach, which can be effective but can also be unattractive as well as difficult to override when it is desirable to interact with the electrical interface. The art may; therefore, welcome an unobtrusive shield that is effective, yet can be easily defeated.

BRIEF DESCRIPTION OF THE INVENTION

Disclosed herein is an electrical interface shield. The shield includes, a transparent support member having a first end and a second end, a transparent housing hingedly attached at the first end of the transparent support member and latchably engagable with the second end, and at least one brace. The at least one brace has at least one mounting hole therethrough and is removably attached to the transparent support member and the at least one mounting hole is configured to receive a fastener therein for mounting the transparent support member to an electrical interface frame.

Further disclosed herein is a method of shielding an electrical interface. The method includes, aligning at least one hole in at least one brace of a transparent support member with an existing fastener-receiving hole of an electrical interface frame and attaching the transparent support member to the electrical interface frame by applying fasteners through the at least one hole in the at least one brace and into the fastener receiving hole. The method further includes rotating a transparent housing hingedly attached to the transparent support member about a hinge and latchedly engaging the transparent housing to the transparent support member.

BRIEF DESCRIPTION OF THE DRAWINGS

The following descriptions should not be considered limiting in any way. With reference to the accompanying drawings, like elements are numbered alike:

FIG. 1 depicts a perspective view of the electrical interface shield disclosed herein in;

DETAILED DESCRIPTION OF THE INVENTION

A detailed description of one or more embodiments of the disclosed apparatus and method are presented herein by way of exemplification and not limitation with reference to the Figures.

Figure 1:
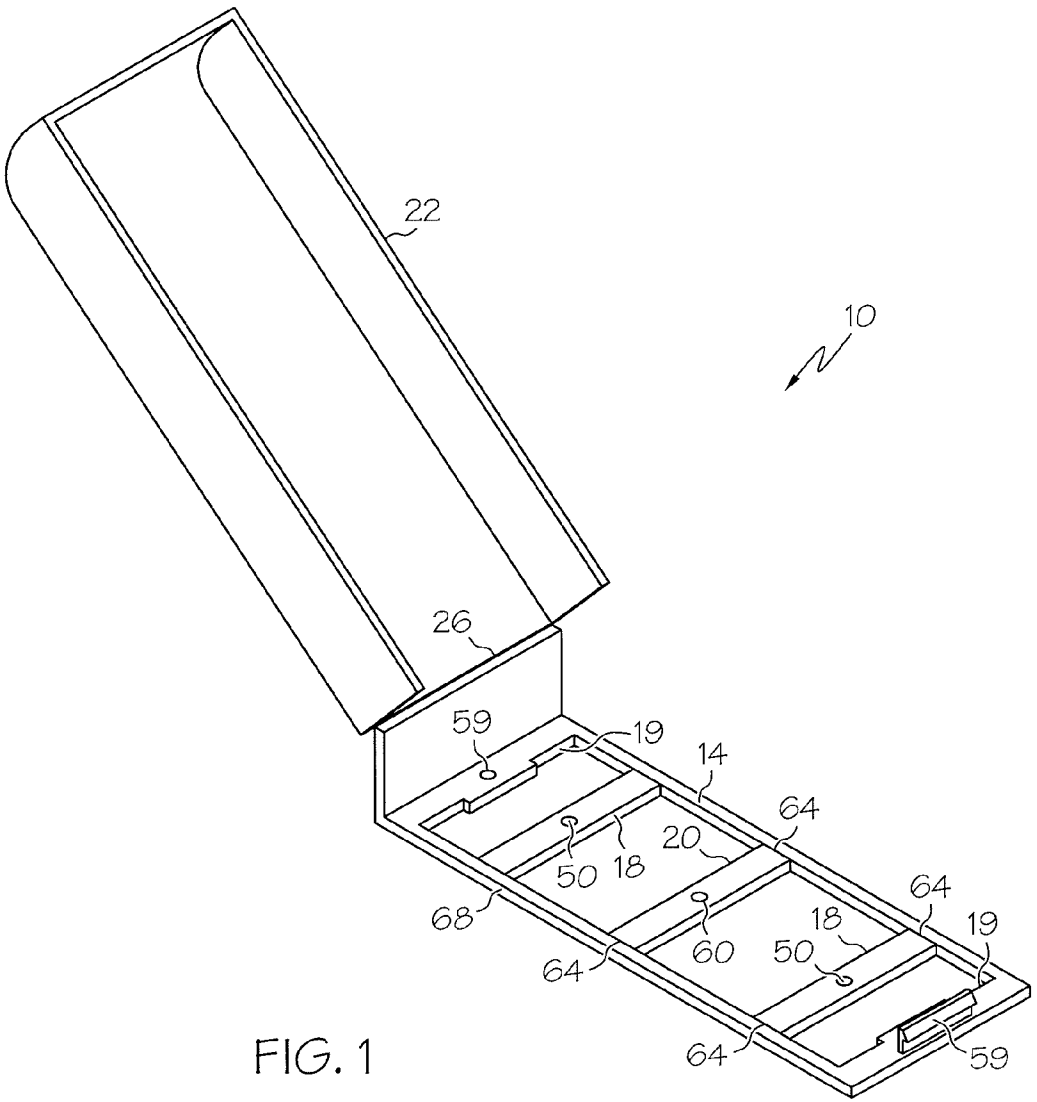

Referring to FIG. 1, an embodiment of the electrical interface shield 10 disclosed herein is illustrated. The interface shield 10 includes: a transparent support member 14 having a plurality of braces 18, 19, 20 and a transparent housing 22. The housing 22 is hingedly attached to the support member 14 at hinge 26 the details of which will be described in greater detail with reference to FIGS. 3-6 below. The hinge 26 allows the housing 22 to close over the support member 14 to thereby prevent access to, inadvertent contact with, and actuation of an electrical interface to which the shield 10 is attached. The support member 14 and the housing 22 are made of transparent material so as to not prevent seeing therethrough. Such transparency will preserve any décor provided therebehind. As such, an injection molded transparent plastic is a good choice for material usage for both the support member 14 as well as the housing 22.

Figure 2:
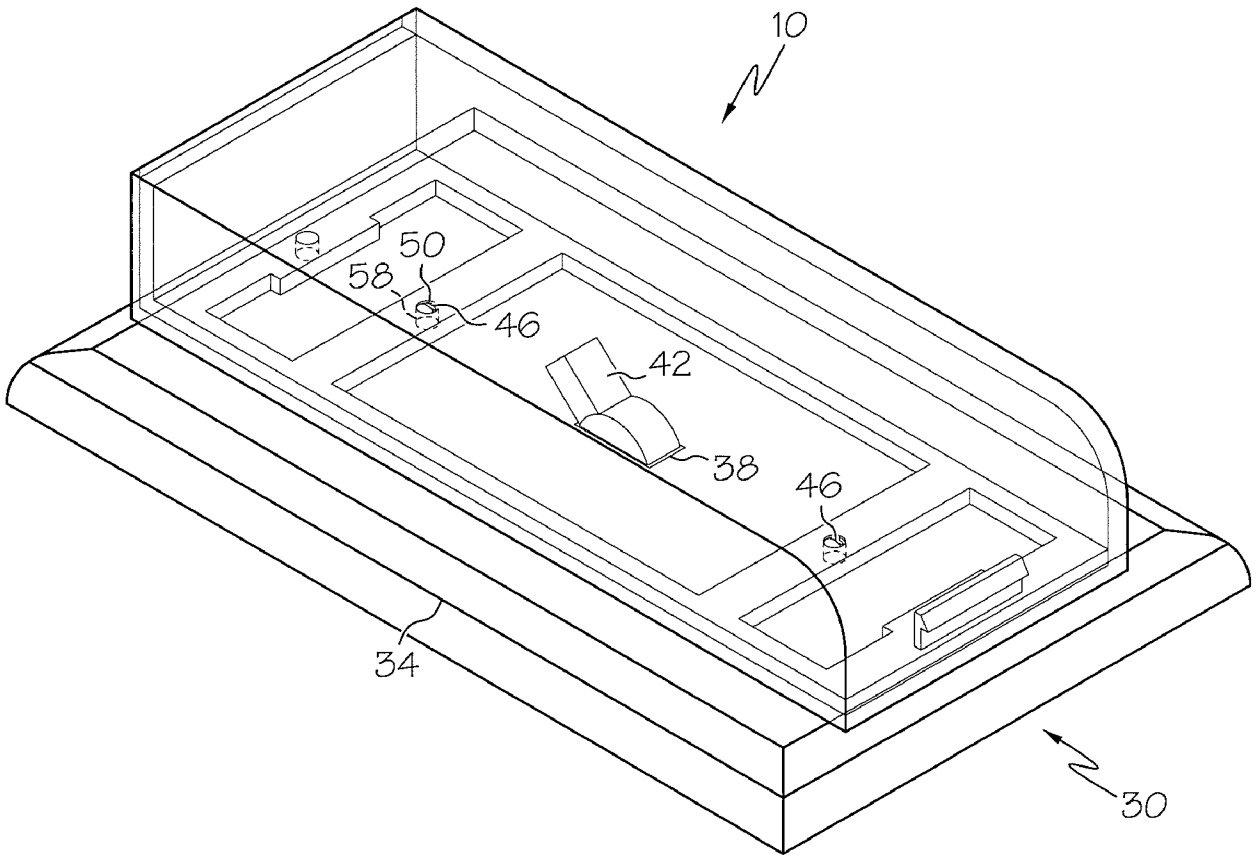
FIG. 2 depicts a perspective view of the electrical interface shield of FIG. 1 shown mounted on wall switch.
Figure 4:
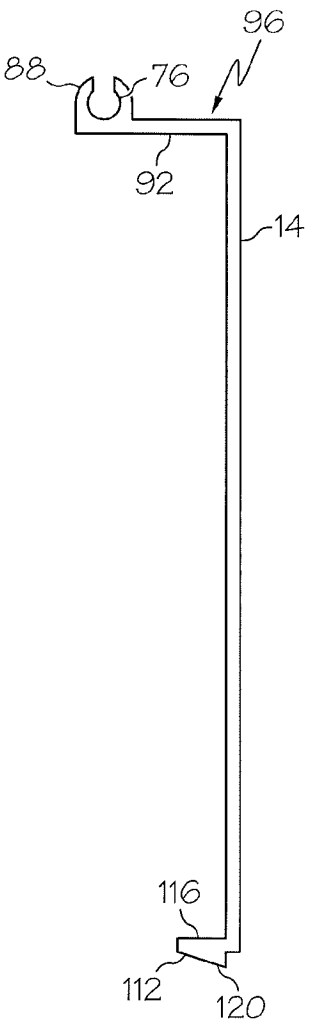
FIG. 4 depicts a side view of the support member of FIG. 3.
Figure 3:
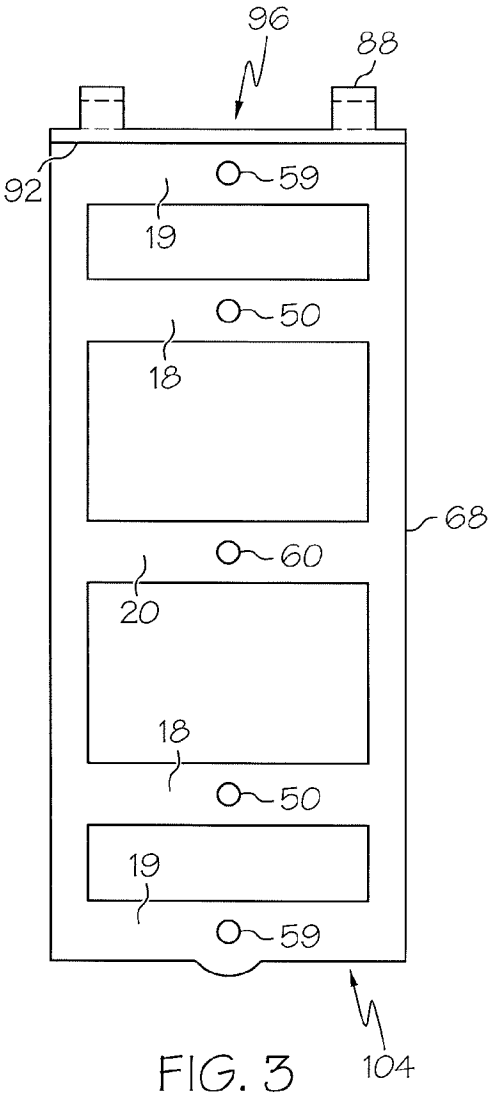
FIG. 3 depicts a plan view of the support member used in the electrical interface shield of FIG. 1.

Referring to FIG. 2, the electrical interface shield 10 is shown mounted to an electrical interface 30. The electrical interface 30, disclosed in this embodiment, is a toggle switch, however, it should be noted that the electrical interface 30 could be other electrical interface devices including; a rocker switch, a light dial dimmer, a light sliding dimmer, an electrical outlet, a coaxial cable outlet and a phone jack, for example. The electrical interface 30 includes an interface plate 34 with a hole 38 therethrough through which a toggle switch lever 42 protrudes. In this embodiment, the support member 14 is attached to the electrical interface 30 with fasteners 46, disclosed herein as screws, which extend through holes 50 in the braces 18 and through holes 58 in the interface plate 34. The location of the holes 58 in the interface plate 34 is defined by standards in the electrical industry to facilitate plate interchangeability.

Such standards exist for all of the different types of standard interface plates. The locations of holes 50, 59 and 60 in the braces 18, 19 and 20 of the support member 14 are, therefore, positioned according to these standards. For example, a rocker switch interface plate (not shown) has the two holes 59 located further apart than the two holes 50 used for the toggle switch interface plate 34. The holes 59 on the support member 14 would therefore be used to mount the support plate 14 to a rocker switch electrical interface. Similarly, a 110-volt electrical outlet interface plate (not shown) has a single fastener-receiving hole at its center through which it is attached to the electrical outlet interface. As such, the support member 14 includes a brace 20 (FIG. 1) with a hole 60 located at the center of the support member 14 to align with the hole in the electrical outlet interface plate.

Such standards allow an embodiment of the electrical interface shield 10 to be supplied with the single support member 14, yet be adaptable for use with a variety of electrical interfaces through simple modifications of the support plate 14. These simple modifications include the removal of one or more of the braces 18, 19, 20 from the support member 14 according to which holes 50, 59, 60 are required for each application. To determine which holes 50, 59, 60 are required, one simply positions the support member 14 over the electrical interface plate and observes which of the holes 50, 59, 60 will be used for that specific interface plate. The unneeded braces 18 and 20, in the rocker switch example, can be cut from the support member 14 with a pair of scissors, for example. To facilitate removal of the braces 18, 20 from the support member 14, lines of wellness 64 can be located at the locations where the braces 18, 19 connect to an outer frame 68, of the support member 14. A localized thinning of the material may form the lines of wellness 64.

The industry standards also control spacing between adjacent electrical interfaces. These standards allow the interface shield 10 to be sized such that one or more interface shields 10 are mountable to a multiple interface frame. For example, a multiple switch interface, also known in the industry as a gang switch, could have individual switches shielded with the interface shields 10, while leaving the remaining switches unshielded. This may be desirable when not all of the switches, in the gang switch, need to be shielded.

Referring to FIGS. 3-6, the support member 14 and housing 22 are illustrated in greater detail. In this embodiment, the hinge 26 is formed from two hinge pins 72 (FIG. 5) of the housing 22 that engage with two C-shaped openings 76 (FIG. 4) of the support member 14. The pins 72 snap into the C-shaped openings 76 through flexing of the C-shaped openings 76. The hinge 26 allows the housing 22 to rotate relative to the support member 14 about the hinge pins 72. The hinge pins 72 protrude toward one another from bosses 80 that extend from a first end 84 of the housing 22. The C-shaped openings 76 are formed in bosses 88 that protrude from a flange 92 on a first end 96 of the support member 14. Alternate embodiments could have hinges with different configurations. The housing and support member could be a single piece of injection-molded plastic with a thin area of plastic forming the hinge, for example. Such a hinge, also referred to as a living hinge, would bend to allow the housing to rotate relative to the support member. Living hinges have the advantage of fewer components and less steps required during assembly.

Rotation of the housing 22, relative to the support member 14, brings a second end 100 of the housing 22, toward a second end 104 of the support member 14. Continued rotation causes an inner surface 108 of the housing 22, to contact an outer surface 112 of a tab 116, protruding from the frame 68 of the support member 14. The outer surface 112 of the tab 116 is ramped to form a hook 120. Applying a small force in the direction of continued rotation causes both the housing 22 and the support member 14 to deform. The flange 92, in particular, may deform to allow the inner surface 108, to ramp along the outer surface 112, until the hook 120 snaps into the recess 124 formed in the second end 100 of the housing 22, thereby latching the second end 108 of the housing 22, with the second end 104 of the support member 14. This latch, however, is easily overcome by one of mature skill such as an adult, for example, as opposed to a small child. To overcome the latch, one simply applies a force to the first end 84, towards the second end 100, while rotating the second end 100 of the housing 22, away from the support member 14. The applied force will flex the flange 92 sufficiently to displace the housing 22, disengaging the hook 120 from the recess 124, thereby unlatching the housing 22 from the support member 14. Alternate latch embodiments could be employed, such as an embodiment with a recess on the tab 116, and a hook on the inside surface 108, for example, to create an alternate disengagable mechanism. Additionally, in an alternate embodiment, the deformable flange 92 could be part of the housing 22, instead of being part of the support member 14. In such an embodiment, a pivot point of the hinge would be in a plane of the frame 68 of the support member 14.

Figure 6:
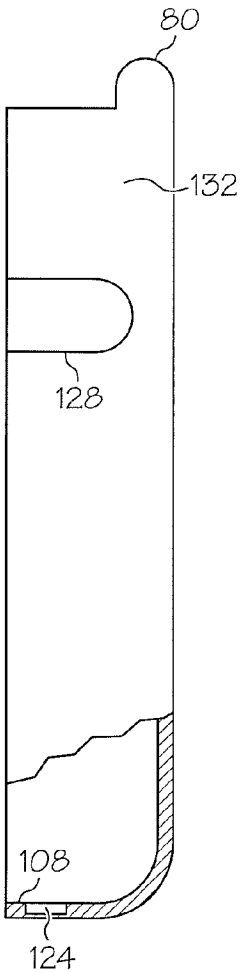
FIG. 6 depicts a partially cross-sectioned side view of the housing of FIG. 5.
Figure 5:
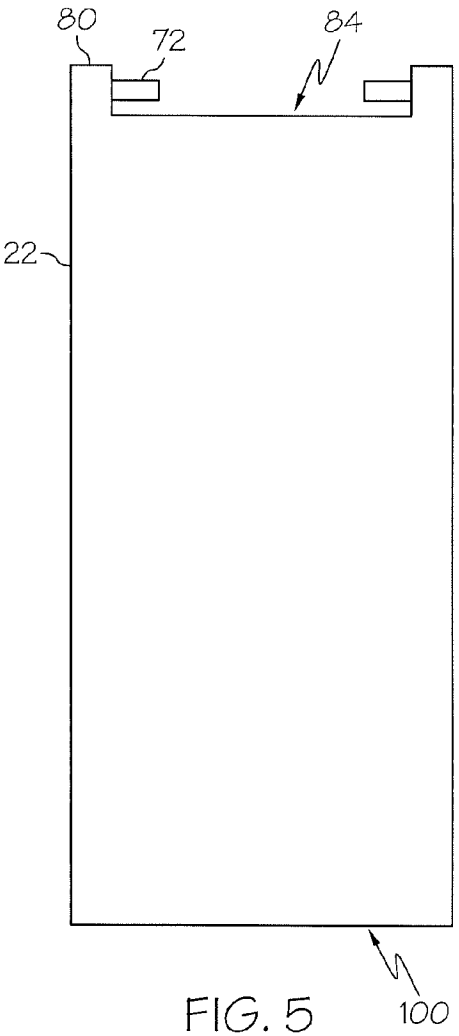
FIG. 5 depicts a plan view of the housing of the electrical interface shield of FIG. 1.

Referring to FIG. 6 specifically, a slot 128 is illustrated in a sidewall 132 of the housing 22. In this embodiment, the slot 128 is in only one sidewall 132, however, alternate embodiments could have multiple slots in multiple sidewalls of the housing 22. The slot 128 allows a conductor (not shown), such as an electrical cord for an appliance, a telephone wire or a coaxial cable, for example, to extend therethrough, while being electrically connected to the electrical interface shielded by the electrical interface shield 10 disclosed herein. A width and depth of the slot 128 may vary; depending upon a size of a conductor anticipated being used in a particular application.

Figure 7:
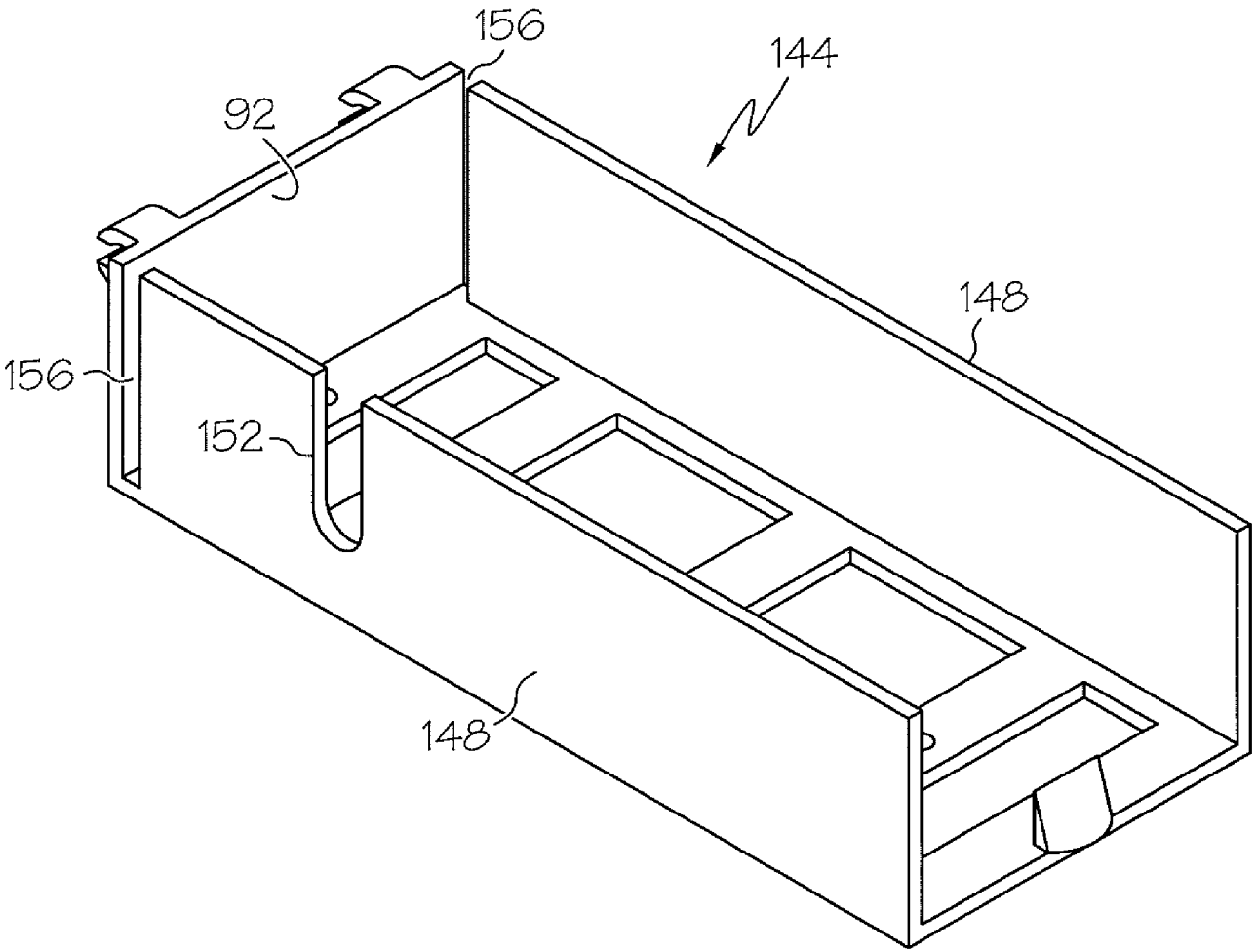
FIG. 7 depicts an alternate support member disclosed herein.

Referring to FIG. 7, an alternate embodiment of a support member 144 is illustrated. The support member 144 differs from the support member 14, in that sidewalls 148 are part of support member 144, whereas the support member 14 did not include such sidewalls. An embodiment using the support member 144 could have a housing (not shown) that does not include sidewalls, since such sidewalls would be redundant. The sidewalls 148 of the support member 144 can have a slot 152 formed therein for routing of a conductor therethrough, in a similar fashion to that used with the slot 128, discussed above. Having the sidewalls 148 connected to the flange 92, would stiffen the flange 92, so that deformation of the flange to disengage the hook 120 from the recess 124 would be difficult. The sidewalls 148, therefore, are not connected to the flange 92, but end at slots 156, thereby leaving room for the flange 92 to deform as described above.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. An electrical interface shield, comprising:

a transparent support member having a first end and a second end and at least one slot therein;

a transparent housing hingedly attached at the first end of the transparent support member and latchably engagable with the second end, the at least one slot of the transparent support member being receptive of an electrical conductor routed therethrough while the transparent housing is latchedly engaged to the second end and the transparent support member is mounted to an electrical interface frame; and at least one brace having at least one mounting hole therethrough being removably attached to the transparent support member, the at least one mounting hole being configured to receive a fastener therein for mounting the transparent support member to an electrical interface frame.

2. The electrical interface shield of claim 1, wherein at least one of the at least one brace further comprises at least one line of weakness.

3. The electrical interface shield of claim 2, wherein the at least one line of weakness includes a reduction in thickness.

4. The electrical interface shield of claim 1, wherein the at least one brace is two braces and each of the braces have a single mounting hole receptive of a screw such that the electrical interface shield is mountable to an electrical interface frame of a light control device.

5. The electrical interface shield of claim 4, wherein the light control device is at least one of a switch and a dimmer.

6. The electrical interface shield of claim 1, wherein the at least one brace is configured to mount to an electrical interface frame of one of an electrical outlet, a coaxial cable outlet and a phone jack.

7. The electrical interface shield of claim 1, wherein the transparent housing is sized to house a portion of an electrical interface that is at least one of a toggle switch, a rocker switch, a dimmer dial and a dimmer slider.

8. The electrical interface shield of claim 1, wherein the electrical interface shield is sized such that a plurality of electrical interface shields are mountable to multiple electrical interfaces on a single multiple electrical interface frame.

9. The electrical interface shield of claim 1, wherein the transparent housing includes at least one slot therein receptive of at least one electrical conductor routed therethrough while the transparent housing is latchedly engaged to the second end and the transparent support member is mounted to an electrical interface frame.

10. The electrical interface shield of claim 9, wherein the at least one slot is sized to receive at least one of an electrical supply cord, a phone cable, a data cable and a coaxial cable.

11. The electrical interface shield of claim 1, wherein the transparent support member is plastic.

12. The electrical interface shield of claim 1, wherein the transparent housing is plastic.

13. The electrical interface shield of claim 1, wherein the transparent support member includes a deformable flange at the first end such that the transparent housing is displaceable by deformation of the deformable flange to allow disengagement of the latchable engagement of the transparent housing with the transparent support member.

14. The electrical interface shield of claim 1, wherein the transparent housing includes a deformable flange at the first end such that the transparent housing is displaceable by deformation of the deformable flange to allow disengagement of the latchable engagement of the transparent housing with the transparent support member.

15. The electrical interface shield of claim 1, wherein the transparent housing and the transparent support member are the same component and the hinge is formed by flexing of the material from which the housing and transparent support member are made.

* * * * *